US005593763A

United States Patent [19]

Kohara et al.

[11] Patent Number: 5,593,763

[45] Date of Patent: Jan. 14, 1997

[54] ACRYLIC FIBROUS MATERIAL AND HUMIDITY CONTROLLER PROVIDED THEREWITH

[75] Inventors: Noriyuki Kohara; Shozo Shigita, both of Okayama, Japan

[73] Assignee: Japan Exlan Company Limited, Osaka, Japan

[21] Appl. No.: 532,988

[22] Filed: Sep. 22, 1995

[30] Foreign Application Priority Data

Oct. 18, 1994 [JP] Japan ..... 6-280081

[51] Int. Cl.[6] ..... B32B 7/02

[52] U.S. Cl. ..... 428/219; 428/245; 428/253; 428/288; 428/903

[58] Field of Search ..... 428/311.1, 219, 428/245, 253, 288, 903

[56] References Cited

U.S. PATENT DOCUMENTS

| | | | |
|---|---|---|---|
| 4,442,173 | 4/1984 | Takegami et al. | 428/372 |
| 4,515,859 | 5/1985 | De Maria et al. | 428/398 |
| 4,562,114 | 12/1985 | Sawanishi et al. | 428/372 |

FOREIGN PATENT DOCUMENTS

| | | |
|---|---|---|
| 3-860 | 1/1991 | Japan . |
| 3-86529 | 4/1991 | Japan . |

*Primary Examiner*—Christopher Raimund

*Attorney, Agent, or Firm*—Wenderoth, Lind & Ponack

[57] ABSTRACT

Disclosed herein is an acrylic fibrous material capable of absorbing and evaporating water stably and rapidly without requiring any water-absorbing material. It finds use as the water-absorbing and -evaporating member of a humidity controller. Disclosed also herein is a humidity controller provided with such an acrylic fibrous material.

2 Claims, No Drawings

ACRYLIC FIBROUS MATERIAL AND HUMIDITY CONTROLLER PROVIDED THEREWITH

BACKGROUND OF THE INVENTION

1. Field of the Invention:

The present invention relates to an acrylic fibrous material which permits water to migrate therein as rapidly as required and also relates to a humidity controller provided with said acrylic fibrous material which absorbs water, evaporates water, and controls humidity adequately.

2. Description of the Prior Art:

There is known an open-cell porous sheet made of fine particles of thermoplastic polymer (such as polyethylene, polypropylene, polystyrene, and polymethyl methacrylate) by sinter forming. It finds use as a water vaporizer. However, its usefulness is limited by its insufficient water absorption capacity and rate which result from the hydrophobic nature of the thermoplastic polymer used as the raw material. Attempts have been made to eliminate the hydrophobic nature. For example, Japanese Patent Laid-open No. 860/1991 discloses a composite nonwoven sheet which is formed by laminating a web of short natural fibers or pulp onto at least one side of a sheet of long composite fibers of sheath-core type. Also, Japanese Patent Laid-open No. 86529/1991 discloses a process for producing a composite material. The process consists of bonding fine silica particles (smaller than 1 μm in diameter) to a composite sheet composed of short fibers and a binder resin. The resulting composite material has a porosity of 40–80% and a water absorption rate higher than 30 mm/10 sec. Despite its high initial water absorption rate, its usefulness is limited by its low water absorption at equilibrium.

The above-mentioned prior art technology has a disadvantage of requiring complex steps for combining a hydrophobic substrate with a hydrophilic, water-absorbing material. Moreover, the composite sheet incorporated with natural fibers or pulp as the water-absorbing material is subject to bacterial attack when immersed in water for a long time for use as a humidity controlling sheet or water vaporizing sheet. With bacterial attack, the composite sheet changes in water absorption and permits bacteria to proliferate thereon and to be scattered in the room together with water vapor. This poses a hygienic problem. In the case where hydrophilic fine particles are bonded to a substrate sheet, they also pose a hygienic problem and affect water absorption as they fall off.

SUMMARY OF THE INVENTION

In order to eliminate the above-mentioned disadvantages involved in the prior art technology, the present inventors carried out a series of researches, which led to the finding that it is possible to produce a material capable of stable and rapid water absorption and also to produce a humidity controller provided with such a material, without using or combining biodegradable natural fibers or pulp and also without resorting to hydrophilic fine particles liable to falling off, if an acrylic fibrous material (composed mainly of acrylic fiber) is used for the inherently hydrophilic substrate.

The gist of the present invention resides in an acrylic fibrous material and a humidity controller in which said acrylic fibrous material functions as the water-absorbing and -vaporizing member, said acrylic fibrous material being composed mainly of acrylic fibers containing more than 50 wt % of acrylonitrile (AN for short hereinafter) and preferably having a monofilament fineness smaller than 1.5 denier, and characterized by an equilibrium water absorption height greater than 100 mm, a water absorption rate greater than 40 mm/20 sec, and an ability to vaporize absorbed water at a rate greater than 1.0 g/m$^2$/min in the atmosphere at 20° C. and 65% RH, said acrylic fibrous material preferably having a density of 0.15–0.60 g/cm$^3$.

It is an object of the present invention to provide an acrylic fibrous material capable of high water absorption and rapid water vaporization which is easy to produce industrially, retains its stable water-absorbing and -vaporizing performance, and is resistant to bacterial attack which poses a hygienic problem. It is another object of the present invention to provide a humidity controller which employs said acrylic fibrous material as the water-absorbing and -vaporizing member. The humidity controller will find use in various fields where moisture absorption, humidity control, and water vaporization are required.

DESCRIPTION OF THE PREFERRED EMBODIMENTS

A detailed description of the present invention follows.

The present invention is characterized by the acrylic fiber used therein. It should be prepared from a homopolymer or copolymer containing more than 50 wt % of acrylonitrile. If this requirement is not met, the resulting acrylic fibrous material will be insufficient in wetting properties and hence in water absorption (in terms of equilibrium water absorption height and water absorption rate).

The copolymer may be prepared from acrylonitrile and any comonomer capable of copolymerization therewith. Examples of the comonomer include $C_{1-4}$ alkyl acrylate, $C_{1-4}$ alkyl methacrylate, acrylic acid, methacrylic acid, methacrylonitrile, acrylamide, vinyl acetate, vinyl chloride, vinyl bromide, vinyl fluoride, vinyl alkylate, vinylidene chloride, vinylidene bromide, styrene, styrenesulfonic acid, allylsulfonic acid, methallylsulfonic acid, styrenesulfonate, allylsulfonate, methallylsulfonate, ethylene, and propylene.

The acrylic fibrous material to be used for the humidity controller should exhibit an equilibrium water absorption height greater than 100 mm so that it vaporizes water sufficiently. (The equilibrium water absorption height determines the effective surface area for water vaporization.) If this requirement is not met, the acrylic fibrous material is insufficient in effective area and hence does not provide water vapor necessary for humidity control. For continuous water vaporization, it is necessary that the acrylic fibrous material be supplied with as much water as it vaporizes. The results of the present inventors' investigation into this matter indicate that if the acrylic fibrous material has an equilibrium water absorption height greater than 100 mm, it should absorb water at a rate greater than 40 mm/20 sec so that it is capable of continuous vaporization. If this requirement is not met, the acrylic fibrous material will become dry because the amount of water vaporization exceeds the amount of water absorption.

As mentioned above, the acrylic fibrous material in the present invention is characterized by an equilibrium water absorption height greater than 100 mm, a water absorption rate greater than 40 mm/20 sec, and an ability to vaporize absorbed water at a rate greater than 1.0 g/m$^2$/min. These characteristic properties are enhanced if the acrylic fiber of acrylonitrile polymer has a monofilament fineness smaller than 1.5 denier, preferably smaller than 1.2 denier. The acrylic fiber is not specifically restricted in its cross-section; however, a round or flat cross-section is preferable.

The acrylic fibrous material will exhibit a better water-absorbing performance if it is prepared from porous acrylonitrile fibers having minute open cells on their surface, which are disclosed in Japanese Patent Publication No. 8084/1989.

The acrylic fibrous material will vary in equilibrium water absorption height and water absorption rate depending on its density. A preferred density is in the range of 0.15 to 0.60 g/cm$^3$. With a density outside this range, it does not produce sufficient capillary action due to excessively large or small interstices between fibers.

The acrylic fibrous material may be in the form of woven or knitted fabric of spun yarn of acrylic fiber alone or blended with other fiber or in the form of nonwoven fabric or paper of unspun acrylic fiber. It may be incorporated with any known binder fiber so that it has the above-specified density. In any case, it should preferably contain more than 30 wt % of acrylic fiber so that it exhibits the water-absorbing properties mentioned above.

The acrylic fiber as the major constituent of the acrylic fibrous material may be blended with antibacterial fibers or may undergo antibacterial treatment (which does not impair the hydrophilic nature of the acrylic fiber). Such blending or treatment will effectively prevent the proliferation of bacteria on the acrylic fibrous material which is used as the water-absorbing and -vaporizing member in a humidity controller.

The present invention also covers a humidity controller in which said acrylic fibrous material functions as the water-absorbing and -vaporizing member. In this case, the acrylic fibrous material may be used alone as such or in combination with a reticulate support or a special functional sheet attached to one or both sides thereof.

Acrylic fiber exhibits a better hydrophilic nature (wettability) than other fibers because they contain cyano groups with a large dipole moment. In addition, this property of acrylic fiber is enhanced when the monofilament fineness and fabric density are adequately controlled. Thus, according to the present invention, it is possible to provide an acrylic fibrous material which exhibits the equilibrium water absorption height and water absorption rate as desired.

EXAMPLES

The invention will be understood more readily by reference to the following examples; however, these examples are intended to illustrate the invention and are not to be construed to limit the scope of the invention.

In the following examples, the equilibrium water absorption height and water absorption rate were measured according to JIS L-1097 (Method B for water absorption rate). The vaporization rate was calculated by dividing the amount of volatile free water (measured according to JIS L-1018, Method B for drying rate) by the drying time (measured according to JIS L-1018, Method A).

Example 1

Three kinds of nonwoven fabrics were prepared by needle punching and heat pressing (in combination) from 70 wt % of acrylic fiber, polyester fiber, or polypropylene (each having a monofilament fineness of 1.5 denier) and 30 wt % of heat-fusible fiber ("EE7", a product of Toyo Boseki K.K.) having a monofilament fineness of 4 denier. The acrylic fiber consisted of 90 wt % of acrylonitrile and 10 wt % of methyl acrylate. The resulting nonwoven fabrics each had a basis weight of 500 g/m$^2$ and a density of 0.40 g/cm$^3$. They were tested for equilibrium water absorption height, water absorption rate, and vaporization rate. The results are shown in Table 1 below. It is noted that the fabric made of acrylic fiber is superior in water absorption height and water absorption rate to other two samples, although all the samples have a vaporization rate greater than 1.0 g/m$^2$/min.

TABLE 1

| Fiber | Equilibrium water absorption height | Water absorption rate | Vaporization rate |
|---|---|---|---|
| Acrylic fiber | 120 mm | 45 mm/20 sec | 1.6 g/m$^2$/min |
| Polyester fiber | 50 mm | 25 mm/20 sec | 1.6 g/m$^2$/min |
| Polypropylene fiber | 40 mm | 18 mm/20 sec | 1.7 g/m$^2$/min |

Example 2

Three kinds of nonwoven fabrics were prepared by needle punching and heat pressing (in combination) from 70 wt % of acrylic fiber A, acrylic fiber B, or acrylic fiber C (each having a monofilament fineness of 1.5 denier) and 30 wt % of heat-fusible fiber ("EE7", a product of Toyo Boseki K.K.) having a monofilament fineness of 2 denier. Acrylic fiber A consisted of 90 wt % of acrylonitrile and 10 wt % of methyl acrylate. Acrylic fiber B consisted of 50 wt % of acrylonitrile and 50 wt % of methyl acrylate. Acrylic fiber C consisted of 40 wt % of acrylonitrile and 60 wt % of methyl acrylate. The resulting nonwoven fabrics each had a basis weight of 500 g/m$^2$ and a density of 0.40 g/cm$^3$. They were tested for equilibrium water absorption height, water absorption rate, and vaporization rate. The results are shown in Table 2 below. It is noted that the fabric made of acrylic fiber C (containing less than 50 wt % of acrylonitrile) is poor in water absorption rate (lower than 40 mm/20 sec) as compared with other two samples, although all the samples are satisfactory in vaporization rate.

TABLE 2

| Fiber | Equilibrium water absorption height | Water absorption rate | Vaporization rate |
|---|---|---|---|
| Acrylic fiber A | 120 mm | 45 mm/20 sec | 1.6 g/m$^2$/min |
| Acrylic fiber B | 105 mm | 42 mm/20 sec | 1.6 g/m$^2$/min |
| Acrylic fiber C | 72 mm | 35 mm/20 sec | 1.8 g/m$^2$/min |

Example 3

Seven kinds of nonwoven fabrics were prepared by needle punching and heat pressing (in combination) from 70 wt % of acrylic fiber (varying in monofilament fineness) and 30 wt % of heat-fusible fiber ("Merty 4080", a product of Unitika Ltd.) having a monofilament fineness of 2 denier. The acrylic fiber is made of the same polymer as used for acrylic fiber A in Example 2. The resulting nonwoven fabrics each had a basis weight of 500 g/m$^2$ and a density of 0.40 g/cm$^3$. They were tested for equilibrium water absorption height, water absorption rate, and vaporization rate. The results are shown in Table 3 below. It is noted that the acrylic fiber with a monofilament fineness smaller than 2.0 denier exhibits a desirable vaporization rate, whereas the acrylic fiber with a monofilament fineness smaller than 1.5 denier are satisfactory in water absorption height and water absorption rate. On the other hand, the acrylic fiber of porous type with a monofilament fineness of 2 denier meets the requirements for both equilibrium water absorption height and water absorption rate in the present invention.

TABLE 3

| Monofilament fineness | Equilibrium water absorption height | Water absorption rate | Vaporization rate |
|---|---|---|---|
| 3.0 denier | 60 mm | 22 mm/20 sec | 0.9 g/m²/min |
| 2.0 denier | 70 mm | 32 mm/20 sec | 1.1 g/m²/min |
| 2.0 denier * | 120 mm | 41 mm/20 sec | 1.0 g/m²/min |
| 1.5 denier | 120 mm | 45 mm/20 sec | 1.6 g/m²/min |
| 1.2 denier | 140 mm | 56 mm/20 sec | 1.9 g/m²/min |
| 1.0 denier | 150 mm | 68 mm/20 sec | 2.2 g/m²/min |
| 0.5 denier | 180 mm | 80 mm/20 sec | 2.4 g/m²/min |

* Porous type

Example 4

Five kinds of nonwoven fabrics varying in density were prepared by needle punching and heat pressing (in combination) from 70 wt % of acrylic fiber having a monofilament fineness of 1.0 denier and 30 wt % of heat-fusible fiber ("EE7", a product of Toyo Boseki K.K.) having a monofilament fineness of 2 denier. (The acrylic fiber is of the same composition as that used in Example 1.) They were tested for equilibrium water absorption height, water absorption rate, and vaporization rate. The results are shown in Table 4 below. It is noted that the samples with a density of 0.1 to 0.65 g/m³ exhibit a vaporization rate greater than 1.0 g/m²/min, and the samples with a density of 0.15 to 0.60 g/cm³ exhibit a satisfactory water absorption height and water absorption rate.

TABLE 4

| Fabric density | Equilibrium water absorption height | Water absorption rate | Vaporization rate |
|---|---|---|---|
| 0.10 g/cm³ | 40 mm | 35 mm/20 sec | 2.5 g/m²/min |
| 0.15 g/cm³ | 120 mm | 55 mm/20 sec | 2.5 g/m²/min |
| 0.40 g/cm³ | 150 mm | 68 mm/20 sec | 2.2 g/m²/min |
| 0.60 g/cm³ | 110 mm | 60 mm/20 sec | 1.4 g/m²/min |
| 0.65 g/cm³ | 85 mm | 38 mm/20 sec | 1.2 g/m²/min |

Example 5

Samples of nonwoven fabrics varying in density were prepared by needle punching and heat pressing (in combination) from 70 wt % of acrylic fiber having a monofilament fineness of 1.0 denier and 30 wt % of heat-fusible fiber ("EE7", a product of Toyo Boseki K.K.) having a monofilament fineness of 2 denier. Each sample (as an evaporator) was built into a humidity controller which was operated for three months. Its performance was compared with that of the one made of pulp. Three months later, it was found that the acrylic evaporator remained almost intact (except for slight staining) but the pulp evaporator entirely discolored black, with partial damages presumably due to biodegradation.

As demonstrated above, the noticeable effect of the present invention is that the acrylic fibrous material made of acrylic fibers having a hydrophilic nature (preferably the one having a monofilament fineness smaller than 1.5 denier) exhibits a sufficient equilibrium water absorption height and water absorption rate, even though it is not combined with natural fiber or pulp (which is liable to microbial attack) or it is not incorporated with hydrophilic fine particles (which easily fall off). Because of its characteristic properties, the acrylic fibrous material will find use as the water-absorbing and -evaporating member of a humidity controller.

What is claimed is:

1. An industrial acrylic fibrous material, characterized in that said material is composed of acrylic fiber containing more than 50 weight % of acrylonitrile and having a monofilament fineness smaller than 1.5 deniers as a main component and a heat-fusible fiber as a subordinate component, said industrial acrylic fibrous material having an equilibrium water absorption height of greater than 100 mm, a water absorption rate of greater than 40 mm/20 sec, an ability to vaporize absorbed water at a rate of greater than 1.0 g/m²/min in the atmosphere at 20° C. and 65% RH, and a density in the range of 0.15 to 0.60 g/cm³.

2. A humidity controller which is provided with the acrylic fibrous material defined in claim 1 as the water-absorbing and -vaporizing member.

* * * * *